US010803782B2

(12) United States Patent
Murase

(10) Patent No.: US 10,803,782 B2
(45) Date of Patent: Oct. 13, 2020

(54) UNEVENNESS CORRECTION DATA GENERATION METHOD AND UNEVENNESS CORRECTION DATA GENERATION SYSTEM

(71) Applicants: IIX INC., Tokyo (JP); PHOTOLAB INC., Urayasu-shi, Chiba-ken (JP)

(72) Inventor: Hiroshi Murase, Urayasu (JP)

(73) Assignees: IIX INC., Tokyo (JP); PHOTOLAB INC., Urayasu-shi (JP)

( * ) Notice: Subject to any disclaimer, the term of this patent is extended or adjusted under 35 U.S.C. 154(b) by 0 days.

(21) Appl. No.: 16/700,052

(22) Filed: Dec. 2, 2019

(65) Prior Publication Data

US 2020/0175907 A1 Jun. 4, 2020

(30) Foreign Application Priority Data

Nov. 30, 2018 (JP) ..... 2018-225901

(51) Int. Cl.
*G09G 3/20* (2006.01)

(52) U.S. Cl.
CPC ... *G09G 3/2003* (2013.01); *G09G 2320/0233* (2013.01); *G09G 2320/0666* (2013.01); *G09G 2320/0686* (2013.01)

(58) Field of Classification Search
CPC ..... G09G 3/2003; G09G 2320/0233; G09G 2320/0666
See application file for complete search history.

(56) References Cited

FOREIGN PATENT DOCUMENTS

WO 2014/128822 A1 8/2014

*Primary Examiner* — Kent W Chang
*Assistant Examiner* — Chayce R Bibbee
(74) *Attorney, Agent, or Firm* — Oliff PLC

(57) ABSTRACT

An unevenness correction data generation method provided for generating unevenness correction data for effectively improving the yield of a display panel. The method includes: a step of capturing an image of a display panel where a predetermined pattern is displayed; a step of generating iteration data for correcting unevenness of the captured image; a step of storing the iteration data in a storage means; a step of capturing an image of the display panel where a pattern in the storage means is displayed; a step of generating iteration data for correcting unevenness of the captured image; a step of storing iteration data in the storage means; a step of judging whether or not an ending condition for ending repetition of the steps is satisfied; and a step of generating the unevenness correction data based on the iteration data stored in the storage means the ending condition is satisfied.

11 Claims, 19 Drawing Sheets

| RANK | SCORE |
|---|---|
| GOLDEN RANK | 0～1 |
| A RANK | 2～3 |
| B RANK | 4～5 |
| C RANK | 6～7 |
| DEFECTIVE PRODUCT | 8～ |

Fig. 11

GRADATION UNEVENNESS

SPOT UNEVENNESS

STRIPE UNEVENNESS

UNEVENNESS CORRECTION DATA GENERATION METHOD AND UNEVENNESS CORRECTION DATA GENERATION SYSTEM

CROSS REFERENCE TO RELATED APPLICATIONS

This application is continuation of and claims the benefit of priority from the prior Japanese Patent Application No. 2018-225901, filed on Nov. 30, 2018, the entire contents of which are incorporated herein by reference.

BACKGROUND OF THE INVENTION

1. Field of the Invention

The present invention relates to an unevenness correction data generation method and an unevenness correction data generation system for generating unevenness correction data for correcting unevenness of a display panel.

2. Description of the Related Art

In a display panel such as a liquid crystal panel or an organic EL panel, luminance unevenness or color unevenness (hereinafter referred to as "unevenness") occurs in an entire screen due to variation in the performance of elements (pixels) and variation in the manufacturing process of the display panel. As for organic EL panels, the yield rate of non-defective products is said to be about 20% at present, and unevenness causes a significant increase in cost.

On the other hand, as a technique for increasing the number of display panels that can be shipped as products by using software to reduce the unevenness of display panels in which unevenness is conspicuous in hardware, there is a correction data generation method described in Patent Document 1, for example. In this method, a test pattern displayed on a display panel is captured using a camera, correction data for correcting unevenness is generated based on the captured image, and an input signal of the display panel is corrected using the correction data, thereby reducing unevenness that occurs in the hardware of the display panel.

RELATED ART DOCUMENTS

Patent Documents

Patent Document 1: JP WO2014/128822A1

SUMMARY OF THE INVENTION

However, although the correction data generation method described in Patent Document 1 aims to obtain highly accurate correction data by capturing a test pattern image a plurality of times for each tone value to suppress the influence of optical shot noise, even when unevenness removal is performed using the correction data obtained in this correction data generation method, the unevenness is not eliminated completely or substantially completely, and some unevenness remains. Depending on how much unevenness remains, there is a problem that defective product areas are not eliminated, and the rate of defective products remains high.

The present invention has been made in view of the above circumstances, and it is an object thereof to provide an unevenness correction data generation method and an unevenness correction data generation system capable of generating unevenness correction data for effectively improving display panel yield.

In order to address the above problem, an unevenness correction data generation method according to the present invention generates unevenness correction data for correcting unevenness of a display panel, the method including: a first image capturing step of capturing an image of a display panel in a state where a predetermined pattern is displayed; a first iteration data generating step of generating iteration data for correcting unevenness of the image captured in the first image capturing step; a first storing step of storing the iteration data generated in the first iteration data generating step in a storage means; a second image capturing step of capturing an image of the display panel in a state where a pattern corrected by the iteration data stored in the storage means is displayed; a second iteration data generating step of generating iteration data for correcting unevenness of the image captured in the second image capturing step; a second storing step of storing, in the storage means, new iteration data obtained by adding the iteration data generated in the second iteration data generating step to the iteration data stored in the storage means; a repeating step of repeating the second image capturing step, the second iteration data generating step, and the second storing step; a judging step of judging whether or not an ending condition for ending the repeating step is satisfied; and an unevenness correction data generating step of generating the unevenness correction data based on the iteration data stored in the storage means when judged in the judging step that the ending condition is satisfied.

The judging step may be performed during the repeating step. For example, the judging step may be performed after the second image capturing step, and before the second iteration data generating step and the second storing step. Alternatively, the judging step may be performed before the second image capturing step, and the ending condition may be that the number of instances of image capturing in the second image capturing step has reached a predetermined number of instances.

The unevenness correction data generation method according to the present invention may include a white noise detecting step of detecting white noise in the image captured in the second image capturing step, with the ending condition being that the white noise was detected, or alternatively, that a number of instances of image capturing in the second image capturing step has reached a predetermined number of instances, or that the white noise was detected before the number of instances of image capturing in the second image capturing step reached the predetermined number of instances.

The unevenness correction data generation method according to the present invention may include a bright line/bright spot detecting step of detecting a bright line or a bright spot in the image captured in the second image capturing step, with the ending condition being that the bright line or the bright spot was detected, or alternatively, that a number of instances of image capturing in the second image capturing step has reached a predetermined number of instances, or that the bright line or the bright spot was detected before the number of instances of image capturing in the second image capturing step reached the predetermined number of instances.

The unevenness correction data generation method according to the present invention may include an iteration score generating step of generating an iteration score that quantifies unevenness of the image captured in the second image capturing step, with the ending condition being that the iteration score is compatible with a preset target.

The iteration score generating step may include: a luminance distribution data calculating step of calculating two-dimensional luminance distribution data of the display panel based on the image captured in the second image capturing step; a filter processing step of performing filter processing on the two-dimensional luminance distribution data, using a filter that is a visual transfer function curve for the display panel such that as spatial frequency increases, recognition sensitivity increases, then reaches a peak and decreases, and in a case where a plurality of such visual transfer function curves are assumed at different distances from the display panel, a visual transfer function curve having visual frequency characteristics approximately passing through a portion where the recognition sensitivity increases as the spatial frequency increases in a short-distance function curve having a short distance from the display panel among the plurality of visual transfer function curves, a peak portion in the short-distance function curve, a peak portion in a far-distance function curve having a far distance from the display panel among the plurality of visual transfer function curves, and a portion where the recognition sensitivity decreases as the spatial frequency increases in the far-distance function curve; and an iteration score calculating step of calculating the iteration score based on two-dimensional filtering data obtained by performing the filter processing using the filter. Alternatively, the iteration score generating step may include a weighting step of performing weighting by assessing that unevenness that occurs in a central portion of the image captured in the second image capturing step is more significant than unevenness that occurs in a peripheral portion.

Also, an unevenness correction data generation system according to the present invention generates unevenness correction data for correcting unevenness of a display panel, the system including: an image capturing means for capturing an image of a pattern displayed on the display panel; an iteration data generation means for generating iteration data for correcting unevenness of the image captured with the image capturing means; a storage means for storing the iteration data generated with the iteration data generation means; an unevenness correction data generation means for generating the unevenness correction data; and a control means for controlling the image capturing means, the iteration data generation means, and the unevenness correction data generation means. In this unevenness correction data generation system, the control means uses the image capturing means to capture an image of a display panel in a state where a predetermined pattern is displayed, uses the iteration data generation means to generate iteration data for correcting unevenness of the captured image, and stores the generated iteration data in the storage means, and afterward, the control means repeats a sequence of using the image capturing means to capture an image of the display panel in a state where a pattern corrected by the iteration data stored in the storage means is displayed, using the iteration data generation means to generate iteration data for correcting unevenness of the captured image, and storing, in the storage means, new iteration data obtained by adding the generated iteration data to the iteration data stored in the storage means, and also judges whether or not an ending condition for ending this repetition is satisfied, and when judged that the ending condition is satisfied, the control means uses the unevenness correction data generation means to generate the unevenness correction data based on the iteration data stored in the storage means.

According to the unevenness correction data generation method and the unevenness correction data generation system of the present invention, it is possible to generate unevenness correction data for effectively improving display panel yield.

BRIEF DESCRIPTION OF THE DRAWINGS

FIG. 11 is an explanatory diagram showing an example of a target unevenness rank set in the unevenness correction data generation system of FIG. 9.

DESCRIPTION OF THE PREFERRED EMBODIMENTS

Embodiments of the present invention will now be described with reference to the accompanying drawings.

Figure 1:
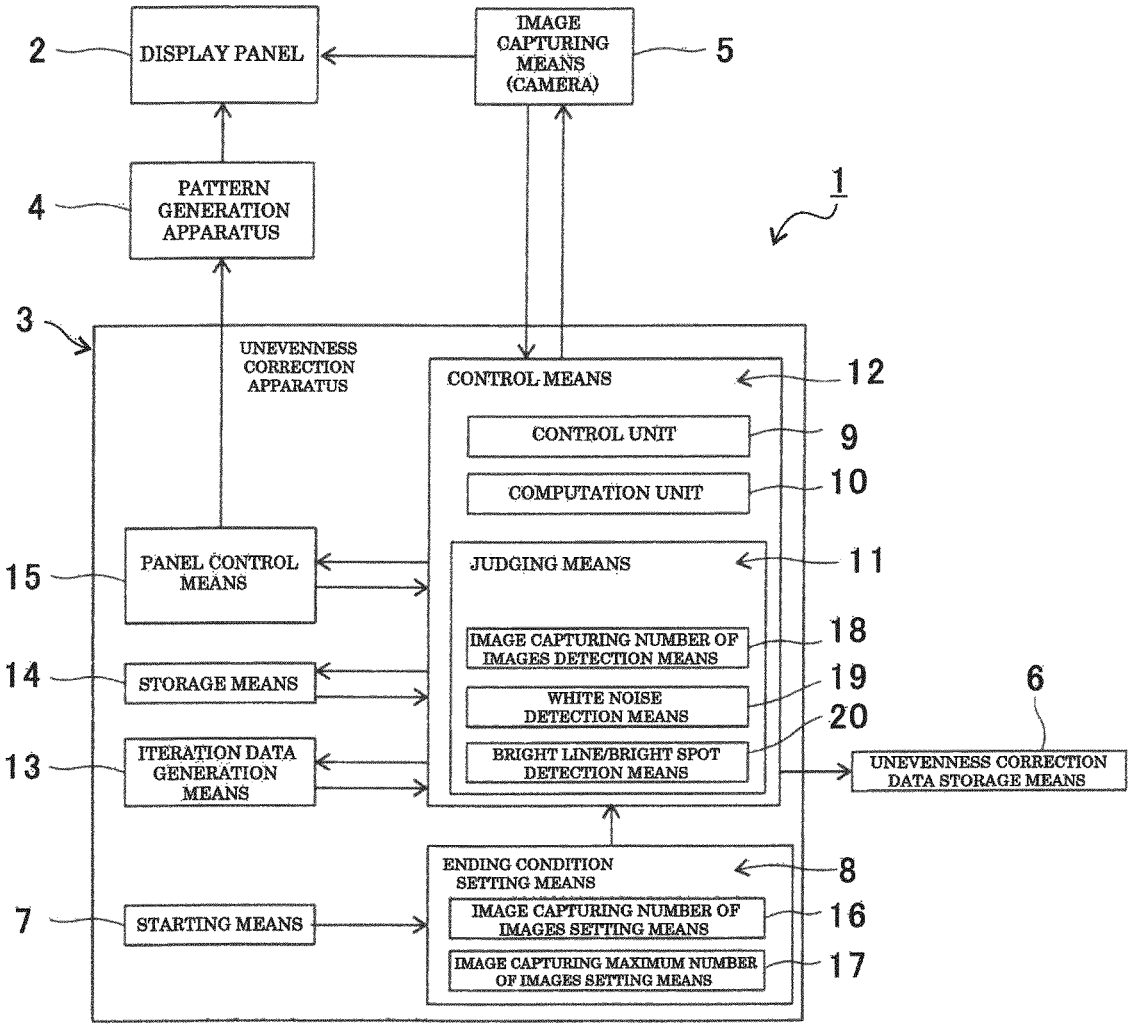
FIG. 1 is a block diagram showing an unevenness correction data generation system according to an embodiment of the invention.

FIG. 1 shows an unevenness correction data generation system according to the present embodiment. This unevenness correction data generation system 1 generates unevenness correction data for correcting unevenness of a display panel 2 such as an organic EL panel or a liquid crystal panel (in the present embodiment, data for generating a signal inverted from the polarity of an unevenness signal, and canceling unevenness by superimposing the generated signal on an input image signal of the display panel). The unevenness correction data generation system 1 includes an unevenness correction apparatus (unevenness correction data generation apparatus) 3, a pattern generation apparatus 4 that displays a predetermined pattern on the display panel 2, an image capturing means 5 configured with a camera having a solid-state image sensor such as a CCD, and an unevenness correction data storage means 6 configured with a memory writer that writes the generated unevenness correction data to a memory (hereinafter referred to as a "mounted memory") such as a ROM configured to be mounted in the display panel 2.

Conceptually, the unevenness correction apparatus 3 includes: a starting means 7 configured with a start button or the like operated when starting generation of unevenness correction data; an ending condition setting means 8 configured with a set button or the like that sets an ending condition of an unevenness correction data generation method (see FIGS. 2, 5 to 8, 10, and 19); a control means 12 configured with a control unit 9, a computation unit 10, and a judging means 11; an iteration data generation means 13 for generating iteration data described later; a storage means 14 configured with a memory or the like that cumulatively stores, in an accumulated manner, captured images of the image capturing means 5 and generated iteration data; and a panel control means 15 for controlling display of the display panel 2. Physically, for example, the control means 12, the iteration data generation means 13, and the panel control means 15 may be configured with one or a plurality of CPUs, and each block of the control unit 9, the computation unit 10, and the judging means 11 in the control means 12 may be configured across a plurality of CPUs rather than a single CPU.

The ending condition setting means 8 is provided with an image capturing number of instances setting means 16 and an image capturing maximum number of instances setting means 17, and the judging means 11 is provided with an image capturing number of instances detection means 18, a white noise detection means 19, and a bright line/bright spot detection means 20.

Figure 2:
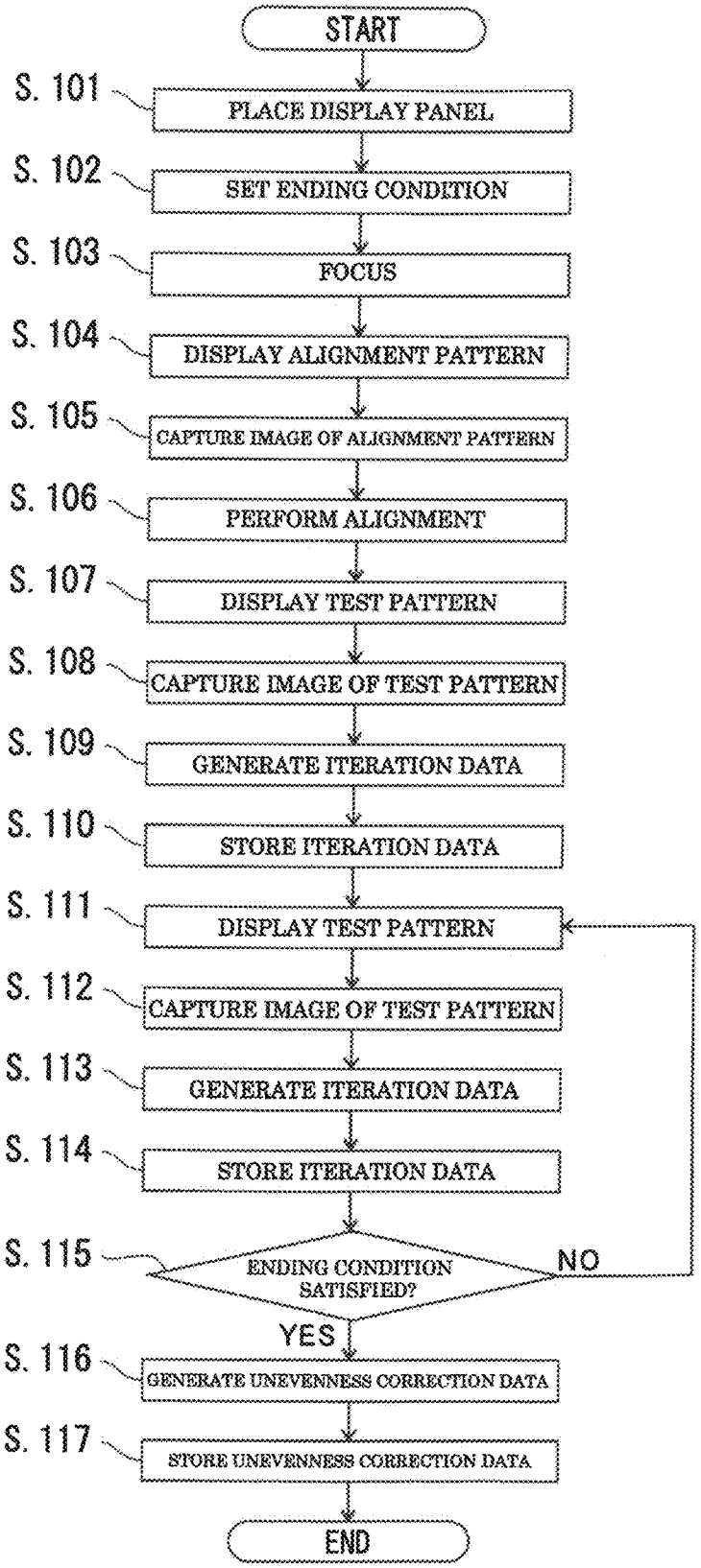
FIG. 2 is a flowchart showing an unevenness correction data generation method according to the unevenness correction data generation system of FIG. 1.

As shown in FIG. 2, in order for the unevenness correction data generation system 1 to generate unevenness correction data for the display panel 2, first, the display panel 2 is placed facing a lens of the image capturing means 5 at a predetermined position in front of the image capturing means 5 (step 101 (denoted as "S. 101" in the drawings; similarly true for steps described hereinafter)). When an ending condition is set by the ending condition setting means 8 after operation of the starting means 7 (step 102), the control unit 9 of the control means 12 adjusts focus of the image capturing means 5 to the display panel 2 (step 103).

Figure 3:
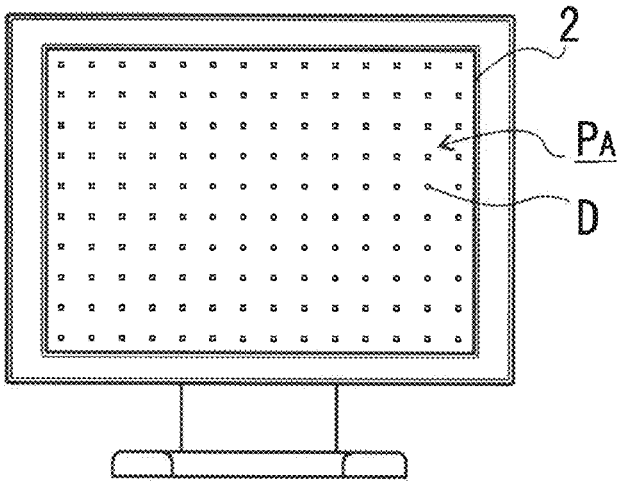
FIG. 3 is an explanatory diagram showing an alignment pattern in the unevenness correction data generation system of FIG. 1.

Next, the control unit 9 uses the panel control means 15 to send an alignment pattern display signal (RGB signal) to the pattern generation apparatus 4, and display an alignment pattern $P_A$ shown in FIG. 3 on the display panel 2 (step 104). In the alignment pattern $P_A$, specific pixels at known positions on the display panel 2 display white (gray), such that square dots D are lined up vertically and horizontally. The control unit 9 uses the image capturing means 5 to capture an image of the display panel 2 on which the alignment pattern $P_A$ is displayed (step 105), detects the position of the image of the alignment pattern $P_A$ on the image capturing plane of the image capturing means 5 (determines which image capturing elements of the image capturing means 5 correspond to the specific pixels on the display panel 2), uses the computation unit 10 to obtain the corresponding relationship (alignment) between the pixels of the display panel 2 and the image capturing elements of the image capturing means, and stores that result in the storage means 14 (step 106).

Figure 4:
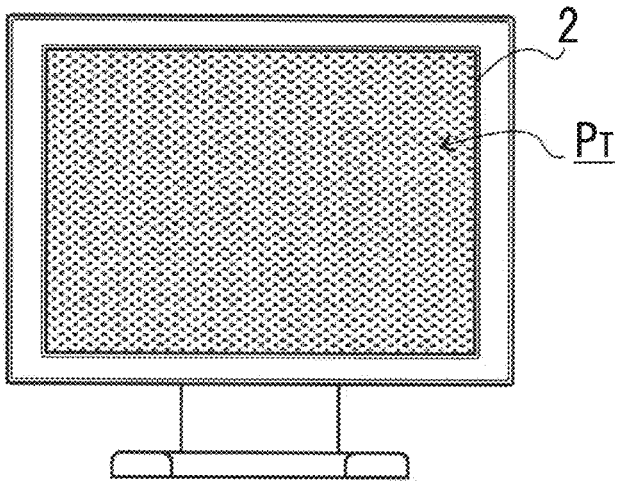
FIG. 4 is an explanatory diagram showing a test pattern in the unevenness correction data generation system of FIG. 1.

When alignment is completed, the control unit 9 uses the panel control means 15 to send a test pattern display signal (RGB signal) to the pattern generation apparatus 7, and display the test pattern $P_T$ shown in FIG. 4 on the display panel 2 (step 107). The test pattern $P_T$ is a raster pattern in which all pixels of the display panel 2 display white (gray) with a predetermined tone. The control unit 9 uses the image capturing means 5 to capture an image of the display panel 2 on which the test pattern $P_T$ is displayed (step 108: first image capturing step), uses the iteration data generation means 13 to generate iteration data (in the present embodiment, this is data for generating a signal inverted from the polarity of an unevenness signal, and canceling unevenness by superimposing the generated signal on an input image signal of the display panel, and is intermediate data for obtaining final unevenness correction data) for correcting unevenness of the image captured in step 108 (step 109: first iteration data generating step), and stores the generated iteration data in the storage means 14 (step 110: first storing step).

Further, the control unit 9 displays the test pattern $P_T$ corrected by the iteration data stored in the storage means 14 on the display panel 2 (step 111), uses the image capturing means 5 to capture an image of the display panel 2 on which the test pattern $P_T$ is displayed (step 112: second image capturing step), uses the iteration data generation means 13 to generate iteration data for correcting unevenness of the image captured in step 112 (step 113: second iteration data generating step), and cumulatively stores the generated iteration data (such that iteration data is added to the iteration data that is already stored, thus creating new iteration data) in the storage means 14 (step 114: second storing step).

Next, the control unit 9 uses the judging means 11 to judge whether or not the ending condition that was set with the ending condition setting means 8 is satisfied (step 115: judging step). If the ending condition is not satisfied, the control unit 9 repeats the processing from step 111 onward, and if the ending condition is satisfied, the control unit 9 generates unevenness correction data based on the iteration data that is stored in the storage means 14 at that point in time, that is, based on iteration data obtained by also adding the iteration data that was obtained with the most recent image capturing (here, the iteration data that is stored in the storage means 14 at that point in time is referred to simply as unevenness correction data (step 116: unevenness correction data generating step)). Then, the control unit 9 uses the unevenness correction data storage means 6 to store this generated unevenness correction data in the mounted memory (step 117).

Figure 5:
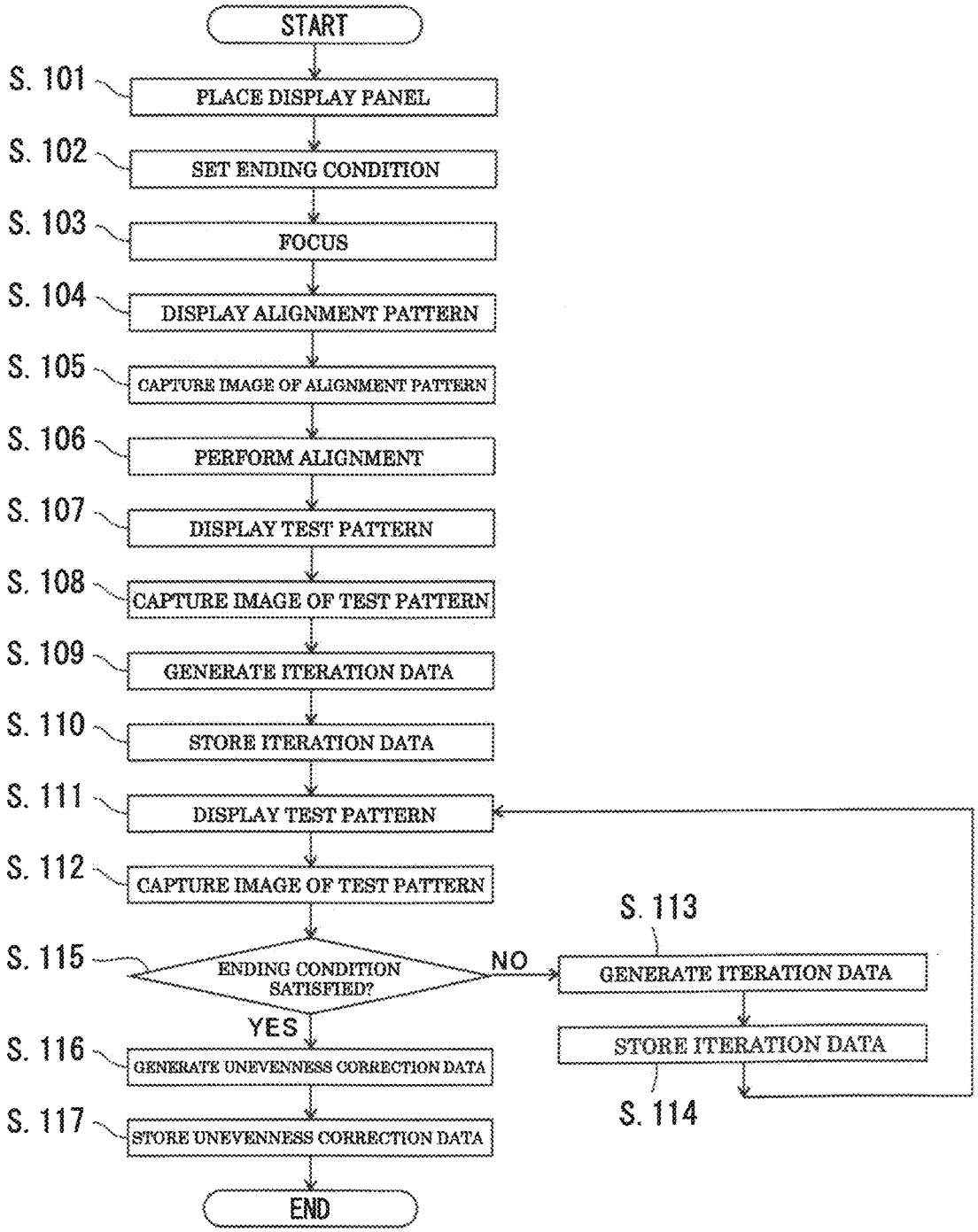
FIG. 5 is a flowchart showing another example of the unevenness correction data generation method according to the unevenness correction data generation system of FIG. 1.

Alternatively, a method may be adopted in which, as shown in FIG. 5, the control unit 9 judges whether or not the ending condition that was set with the ending condition setting means 8 is satisfied immediately after step 112 (step 115), and if the ending condition is not satisfied, after the processing of steps 113 and 114, the control unit 9 repeats the processing from step 111 onward, and if the ending condition is satisfied, the control unit 9 generates unevenness correction data based on the iteration data that is stored in the storage means 14 at that point in time, that is, based on iteration data obtained by adding up to the iteration data that was obtained with image capturing one instance prior to the most recent image capturing (step 116), and then the control unit 9 uses the unevenness correction data storage means 6 to store this generated unevenness correction data in the mounted memory (step 117). In comparison to the unevenness correction data generation method shown in FIG. 2, the unevenness correction data generation method shown in FIG. 5 has one less iteration data generating step before proceeding to step 116, so takt time can be shortened.

Figure 6:
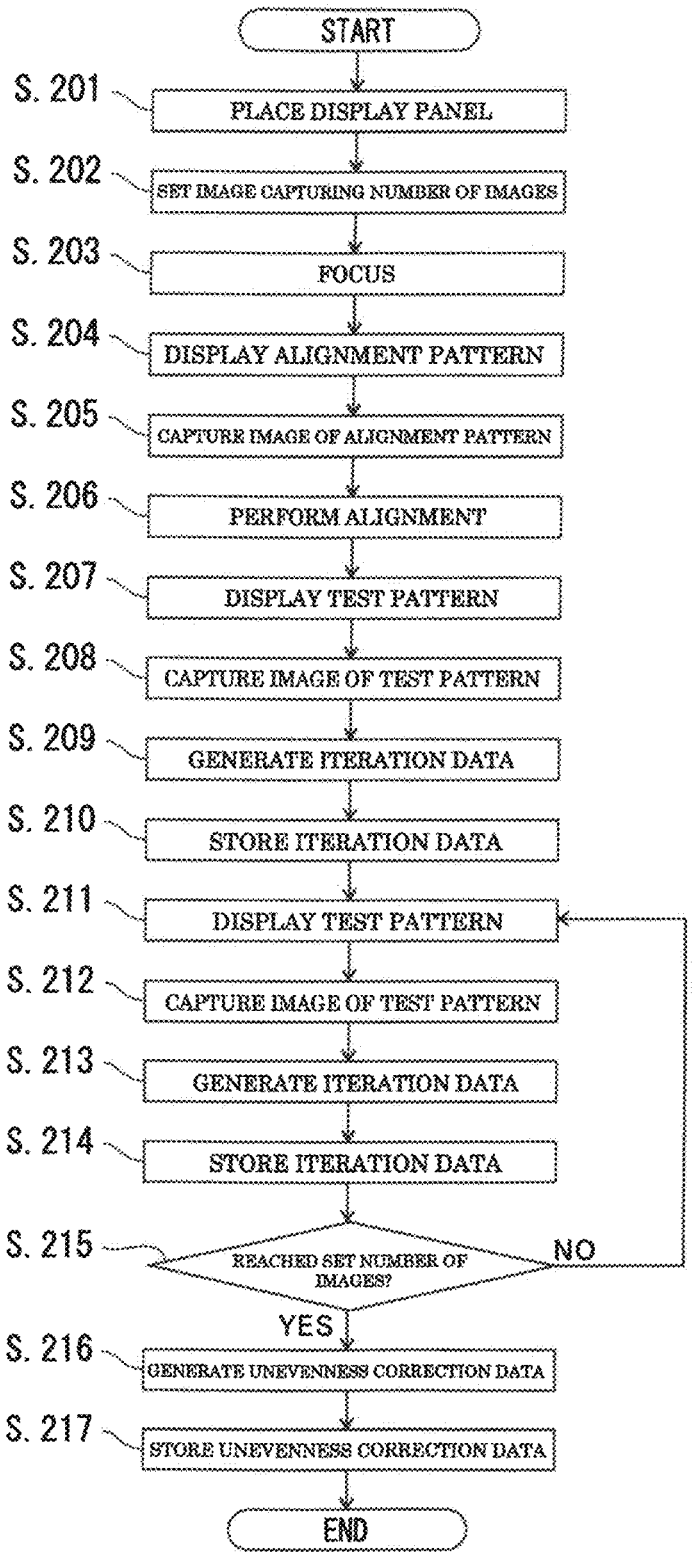
FIG. 6 is a flowchart showing an example in which a number of instances of image capturing is used as an ending condition in the unevenness correction data generation method of FIG. 2.

In the unevenness correction data generation method shown in FIG. 2, in a case where a number of instances of image capturing is used as the ending condition, as shown in FIG. 6, the display panel 2 is placed (step 201), and when the number of instances of image capturing is set as the ending condition by the image capturing number of instances setting means 16 (step 202), the control unit 9, after performing processing of steps 203 to 214 similar to the processing of steps 103 to 114, judges whether or not the number of instances of image capturing up to that point has reached the number of instances that was set in step 202 (step 215: judging step). Then, if that number of instances has not been reached, the control unit 9 repeats the processing from step 211 onward, and if that number of instances has been reached, the control unit 9 generates unevenness correction data based on the iteration data stored in the storage means 14 at that point (step 216), and uses the unevenness correction data storage means 6 to store this generated unevenness correction data in the mounted memory (step 217).

Also, in the unevenness correction data generation method shown in FIG. 2, it is possible to adopt white noise detection as the ending condition. White noise is noise that exhibits the same level of intensity in the entire frequency band in the power spectrum, and occurs due to performance limits of an apparatus. Therefore, when white noise is detected, there is no unevenness that should be corrected, so after white noise is detected it does not make sense to repeatedly generate iteration data. However, it is desirable to set a maximum number of instances of image capturing in order to avoid repeating generation of iteration data indefinitely in a case where white noise is not detected. White noise detection is performed by the white noise detection means 19 as described below, and specifically, for example, a technique is conceivable in which typical frequency characteristics of white noise are stored in advance, and white noise is detected by comparison with those typical frequency characteristics.

Figure 7:
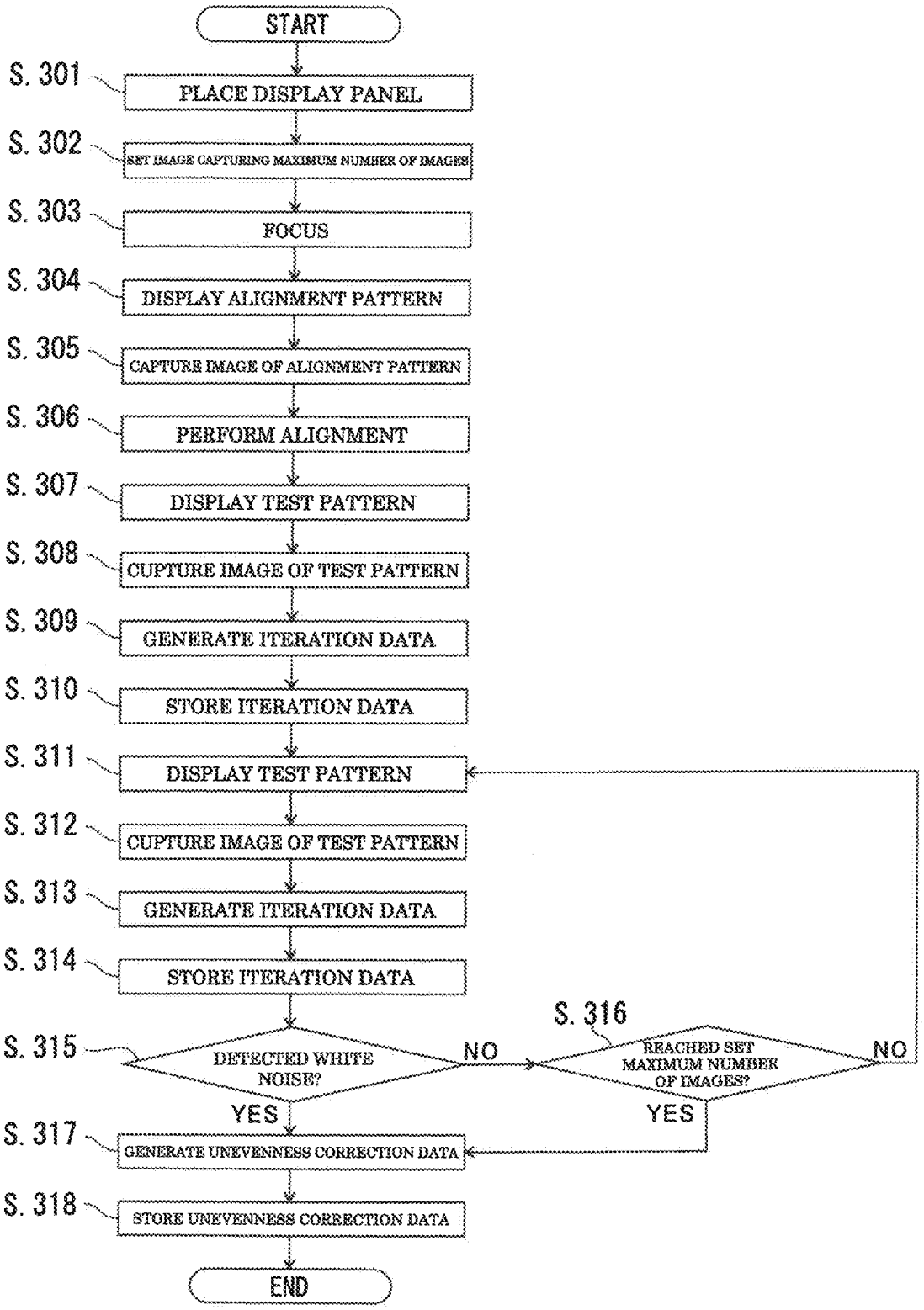
FIG. 7 is a flowchart showing an example in which white noise detection is used as the ending condition in the unevenness correction data generation method of FIG. 2.

In a case where white noise detection is used as the ending condition in this way, as shown in FIG. 7, the display panel 2 is placed (step 301), and when an image capturing maximum number of instances is set as the ending condition by the image capturing maximum number of instances setting means 17 (step 302), the control unit 9, after performing processing of steps 303 to 314 similar to the processing of steps 103 to 114, uses the white noise detection means 19 to judge whether or not white noise is detected in the captured image (step 315: white noise detecting step). Then, if white noise is not detected, the control unit 9 judges whether or not the number of instances of image capturing up to that point has reached the maximum number of instances that was set in step 302 (step 316: judging step), and if the maximum number of instances has not been reached, the control unit 9 repeats the processing from step 311 onward, and if the maximum number of instances has been reached, the control unit 9 generates unevenness correction data based on the iteration data stored in the storage means 14 at that point (step 317), and uses the unevenness correction data storage means 6 to store this generated unevenness correction data in the mounted memory (step 318). On the other hand, if white noise is detected in step 315, the control unit 9 generates unevenness correction data based on the iteration data stored in the storage means 14 at that point (step 317), and uses the unevenness correction data storage means 6 to store this generated unevenness correction data in the mounted memory (step 318).

Furthermore, in the unevenness correction data generation method shown in FIG. 2, instead of white noise detection, it is possible to adopt bright line or bright spot detection as the ending condition. A bright line occurs due to a phenomenon in which, when the display panel is an organic EL panel, an inverse bias voltage applied to a short-circuited organic EL laminated body flows to a normal organic EL laminated body and the display panel becomes lit. This phenomenon occurs along a scanning line, and therefore appears as a single linear bright line. A bright spot occurs due to a defective pixel whose current is always on. When surrounding pixels are displaying black, if there is a bright spot of even a single pixel, this is visible to an observer and becomes a problem. Bright lines and bright spots are caused by pixel defects, and even if they are recognized as unevenness and correction is applied, they are not improved. As a result, display panels in which a bright line or a bright spot is detected are defective products that cannot be repaired, so it does not make sense to repeatedly generate iteration data after detection of a bright line or a bright spot. However, it is desirable to set a maximum number of instances of image capturing in order to avoid repeating generation of iteration data indefinitely in a case where a bright line or a bright spot is not detected. Detection of a bright line or a bright spot is performed by the bright line/bright spot detection means 20 as described below, and specifically, for example, a technique is conceivable in which a singular line (a bright line that is extremely bright or extremely dark) or a singular point (a bright spot that is extremely bright or extremely dark) in an image of a full-screen gray display is detected.

Figure 8:
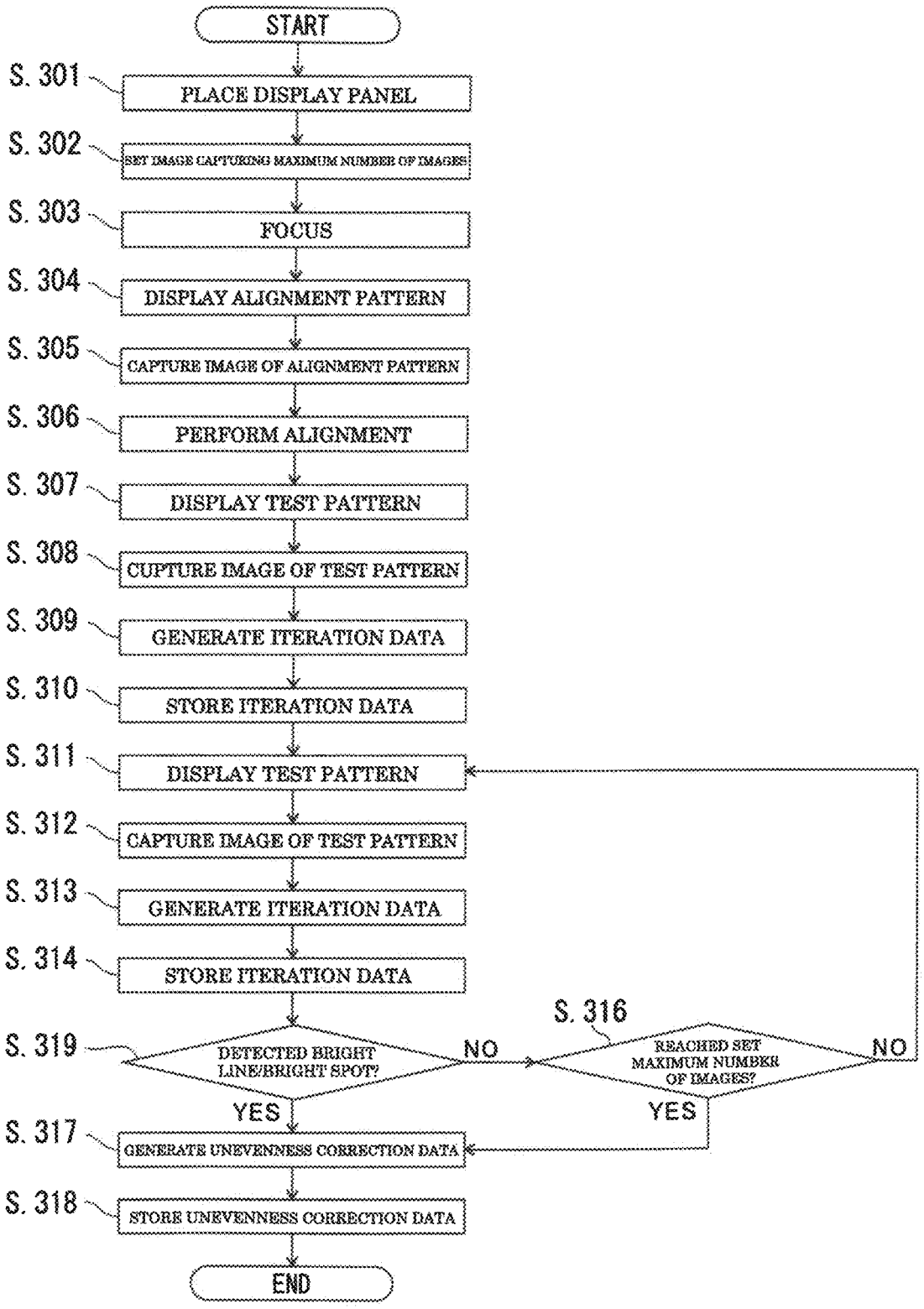
FIG. 8 is a flowchart showing an example in which bright line/bright spot detection is used as the ending condition in the unevenness correction data generation method of FIG. 2.

In a case where detection of a bright line or a bright spot is used as the ending condition in this way, as shown in FIG. 8, step 315 in FIG. 7 may be replaced with step 319, and here, the control unit 9, after performing processing of steps 303 to 314, uses the bright line/bright spot detection means 20 to judge whether or not a bright line or a bright spot is detected in the captured image (step 319: bright line/bright spot detecting step). Then, if a bright line or a bright spot is not detected, the control unit 9 judges whether or not the number of instances of image capturing up to that point has reached the maximum number of instances that was set in step 302 (step 316), and if the maximum number of instances has not been reached, the control unit 9 repeats the processing from step 311 onward, and if the maximum number of instances has been reached, the control unit 9 generates unevenness correction data based on the iteration data stored in the storage means 14 at that point (step 317), and uses the unevenness correction data storage means 6 to store this generated unevenness correction data in the mounted memory (step 318). On the other hand, if a bright line or a bright spot is detected in step 319, the control unit 9 generates unevenness correction data based on the iteration data stored in the storage means 14 at that point (step 317), and uses the unevenness correction data storage means 6 to store this generated unevenness correction data in the mounted memory (step 318), but the mounted memory is not used because the display panel 2 is a defective product, so processing may be ended without performing steps 317 and 318.

Figure 9:
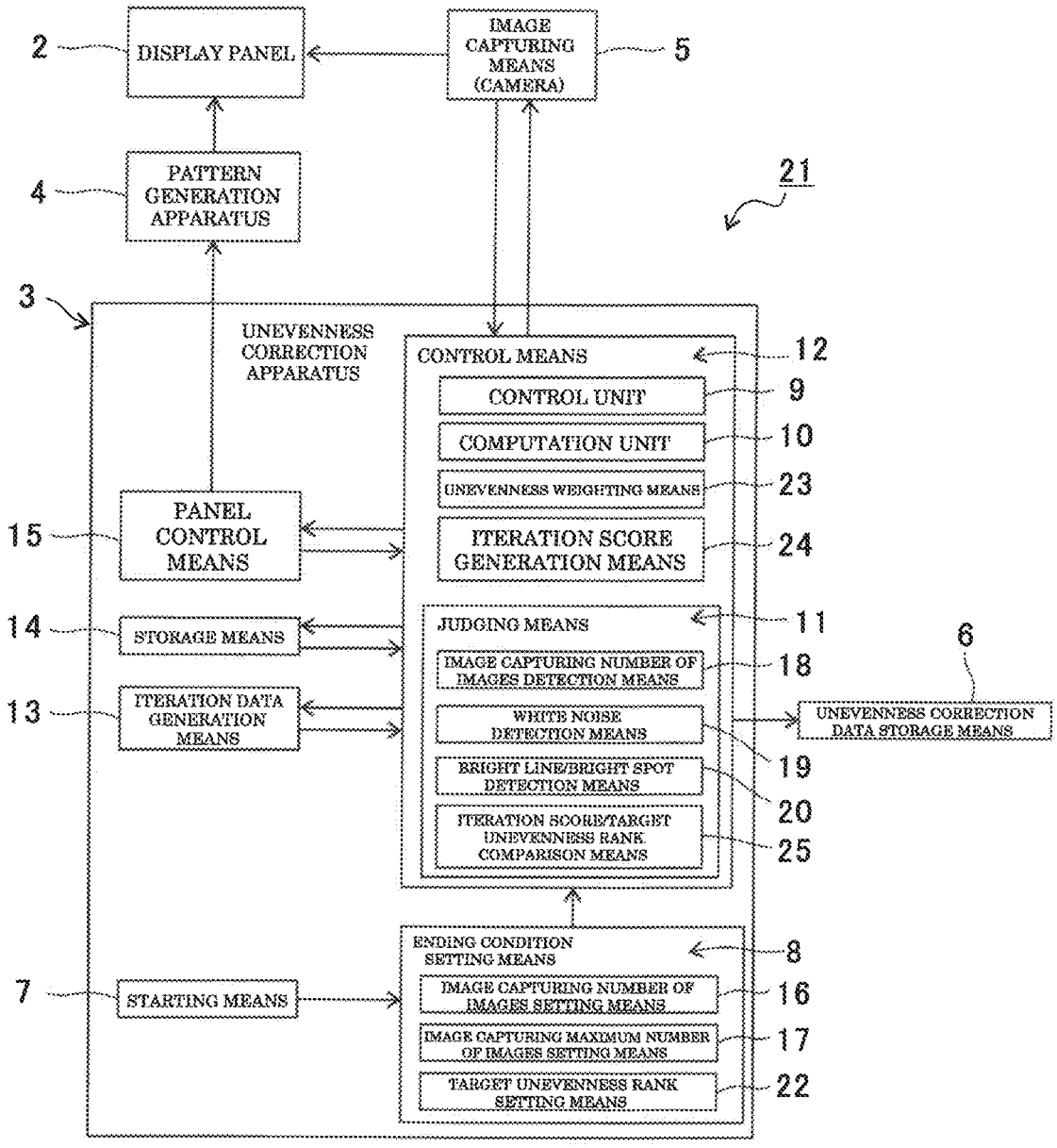
FIG. 9 is a block diagram showing another example of an unevenness correction data generation system according to an embodiment of the invention.

FIG. 9 shows another unevenness correction data generation system according to the present embodiment. In this unevenness correction data generation system 21, the unevenness correction data generation system 1 is modified by adding a target unevenness rank setting means 22 to the ending condition setting means 8, and by adding an unevenness weighting means 23, an iteration score generation means 24, and an iteration score/target unevenness rank comparison means 25 to the control means 12.

Figure 10:
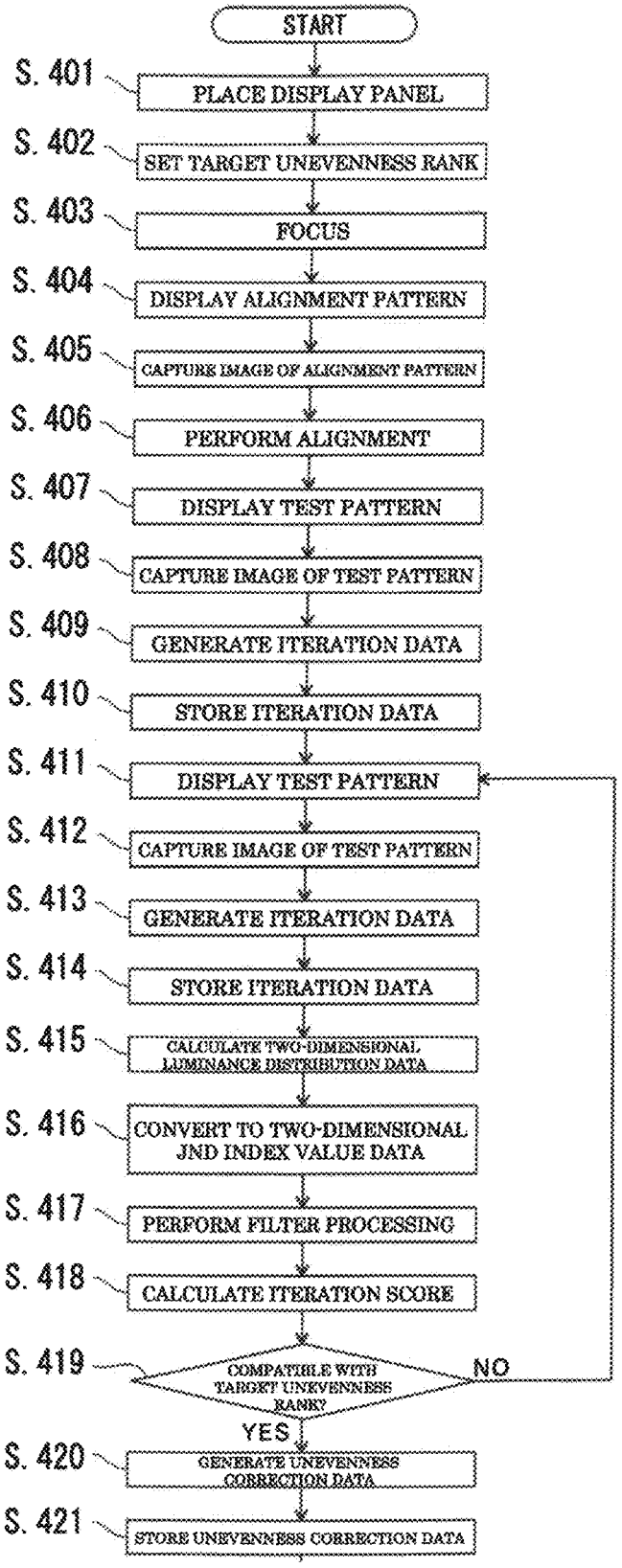
FIG. 10 is a flowchart showing an unevenness correction data generation method according to the unevenness correction data generation system of FIG. 9.

As shown in FIG. 10, in order for the unevenness correction data generation system 21 to generate unevenness correction data for the display panel 2, first, the display panel 2 is placed (step 401), and when a target unevenness rank is set as the ending condition by the target unevenness rank setting means 22 (step 402), the control unit 9, after performing processing of steps 403 to 414 similar to the processing of steps 103 to 114, uses the computation unit 10 to calculate a luminance of each pixel of the display panel 2 using, for example, a technique described in JP 2016-004037A, and stores two-dimensional luminance distribution data of the display panel 2 calculated in this way in the storage means 14 (step 415: luminance distribution data calculating step).

Here, the target unevenness rank is used to grade image quality (an unevenness quantity) of the display panel 2 according to the numerical value of an iteration score described later. For example, as shown in FIG. 11, when the iteration score is in a minimum range, the unevenness rank is "golden rank" and there is little unevenness, and as the iteration score increases, the unevenness rank successively drops to "A Rank", "B Rank", and "C Rank", and unevenness increases. When the iteration score exceeds a certain value, the unevenness rank becomes "defective product". In step 402, a target of which rank of image quality is to be obtained for the display panel 2 is set as the target unevenness rank.

The control unit 9 converts the two-dimensional luminance distribution data calculated in step 415 into JND index values (step 416). A JND (Just-Noticeable Difference) is the (minimum) luminance difference of a given target that is just noticeable by an average human observer under given viewing conditions. The JND index values are luminance values arranged from 1 to 1023 such that, assuming 0.05 cd/m$^2$ is an index 1, the luminance difference from the next index is exactly a JND.

Figure 12:
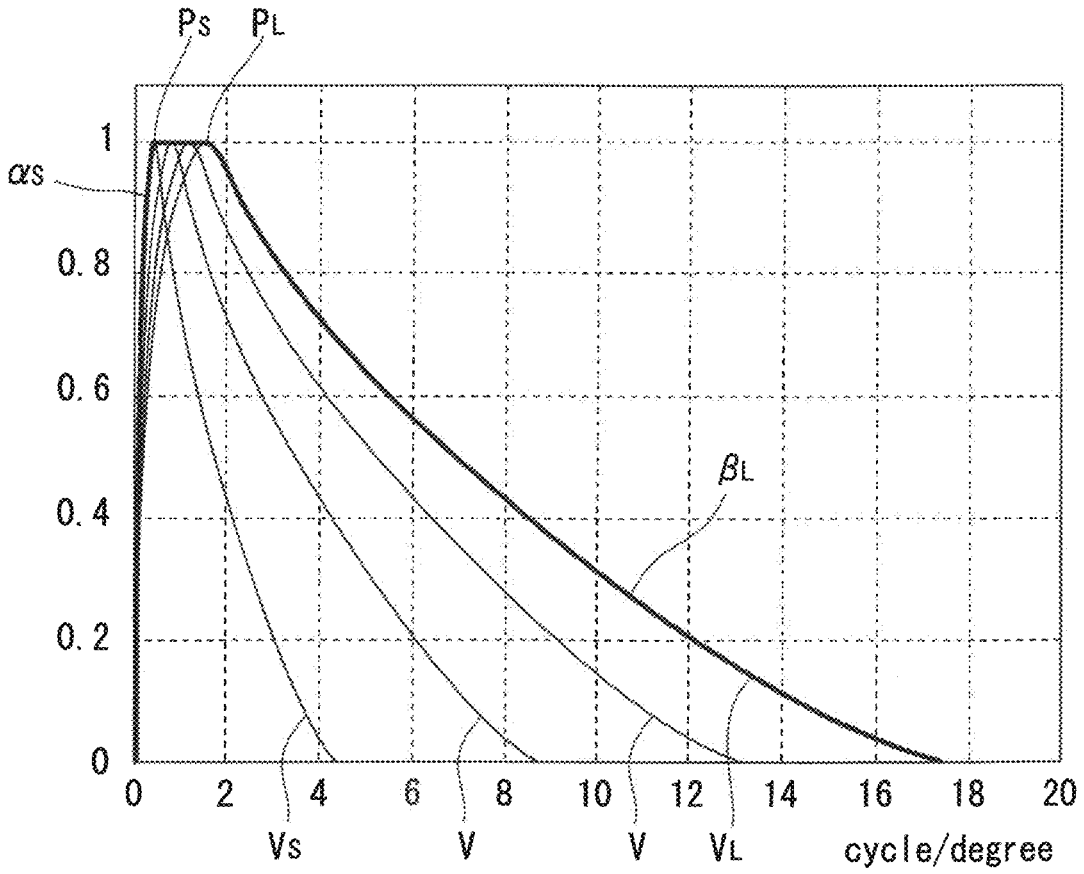
FIG. 12 is an explanatory diagram showing filter characteristics of the unevenness correction data generation system of FIG. 9.

Then, for the two-dimensional data of the JND index values, the control unit 9 performs filter processing using a two-dimensional digital filter, and stores the result in the storage means 14 (step 417: filter processing step). As shown in FIG. 12, the filter used here is a visual transfer function curve for a display panel such that as spatial frequency increases, recognition sensitivity increases, then reaches a peak and decreases. In a case where a plurality of such visual transfer function curves are assumed at different distances from the display panel, for a visual transfer function curve having visual frequency characteristics (see the thick line in FIG. 12) approximately passing through a portion as where the recognition sensitivity increases as the spatial frequency increases in a short-distance function curve $V_S$ having a short distance from the display panel among a plurality of visual transfer function curves V, a peak portion $P_S$ of the short-distance function curve, a peak portion $P_L$ of a far-distance function curve $V_L$ having a far distance from the display panel among the plurality of visual transfer function curves V, and a portion $\beta_L$ where the recognition sensitivity decreases as the spatial frequency increases in the far-distance function curve, this visual transfer function curve is expressed by the following equations.

$$V=v_1\times(v_2+v_3)\times 1.46032$$

$$v_1=1-\exp(-f^{0.75}\times 1.333)$$

$$v_2=\exp(-f^{1.2}\times 0.163)$$

$$v_3=\exp\{-(f-7.59)^2\times 0.0246\}\times 0.13$$

$f$: spatial frequency (cycle/degree)

Figure 13:
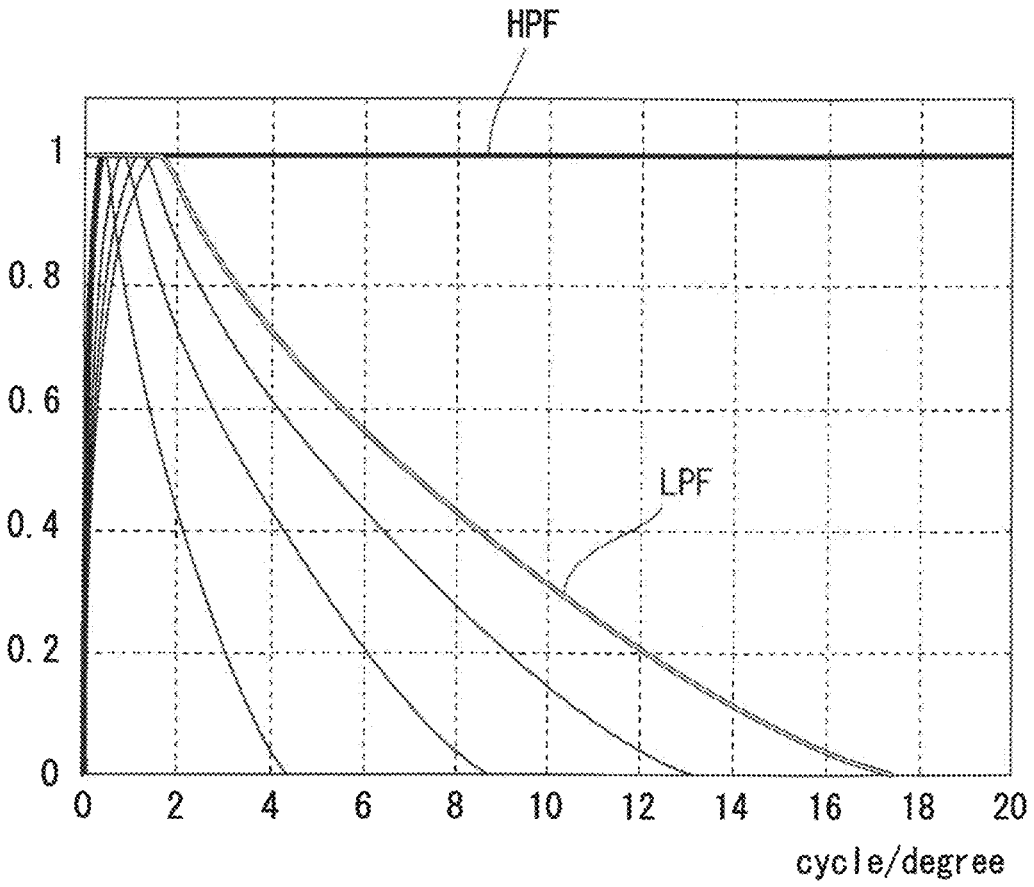
FIG. 13 is an explanatory diagram showing characteristics of a low-pass filter and a high-pass filter constituting the filter characteristics of FIG. 12.
Figure 14:
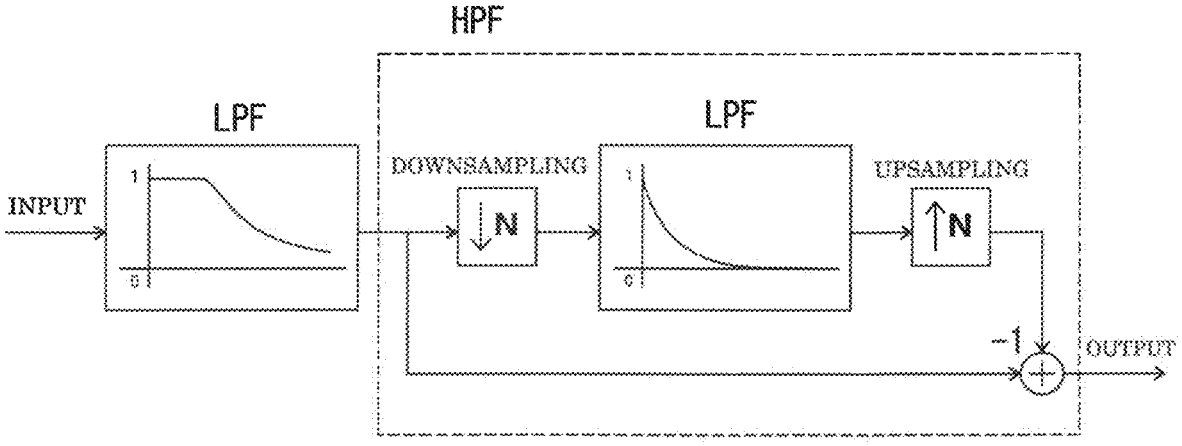
FIG. 14 is a block diagram showing processing of the low-pass filter and the high-pass filter constituting the filter characteristics of FIG. 12.

Also, the filter is configured with a cascading connection of a low-pass filter (LPF) and a high-pass filter (HPF) having the characteristics shown in FIG. 13, and as shown in FIG. 14, the high-pass filter is configured by a combination of downsampling by a factor of 1/N, a low-pass filter, and upsampling by a factor of N.

Figure 15:
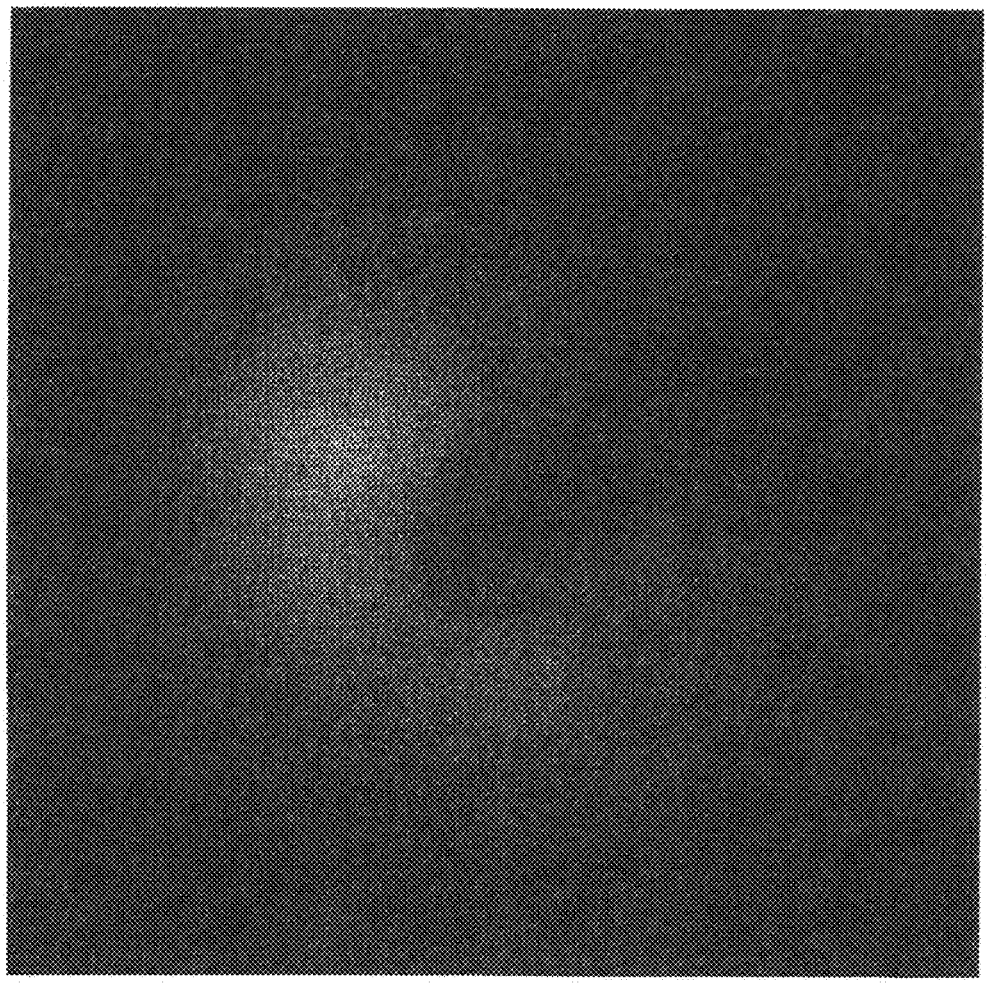
FIG. 15 is an explanatory diagram showing an example of two-dimensional luminance distribution data of a display panel in FIG. 9.
Figure 16:
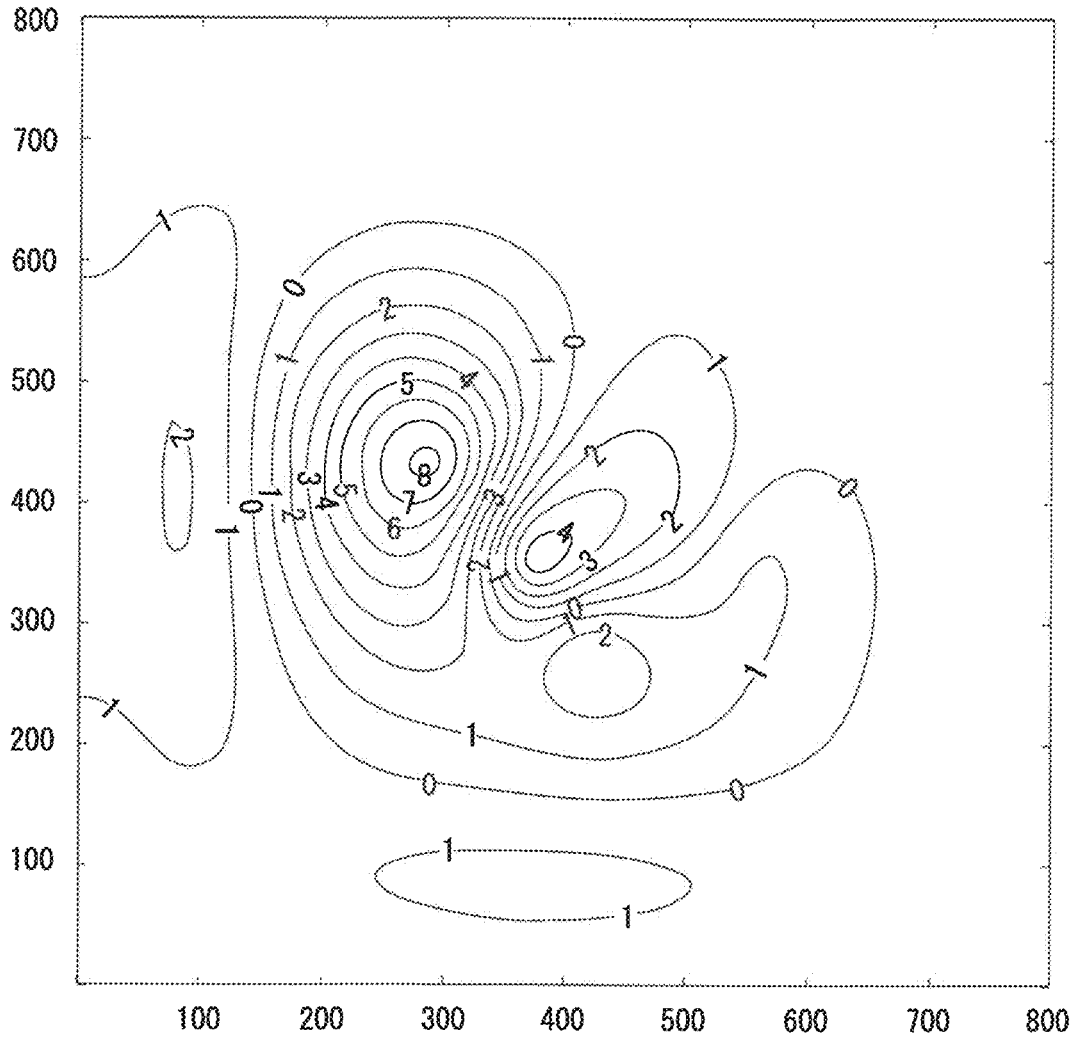
FIG. 16 is an explanatory diagram showing an example in which the two-dimensional luminance distribution data of FIG. 15 is converted to two-dimensional filtering data.

Incidentally, when performing filter processing on the two-dimensional data of the JND index values, because the direct current gain of the filter is 0, the output is a value that swings positive or negative around 0, and this output represents the intensity of unevenness of each part of the display panel 2. For example, when the two-dimensional luminance distribution data shown in FIG. 15 is converted into JND index values and then the filter processing is performed, the two-dimensional filtering data shown in FIG. 16 is obtained. The control unit 9 uses the computation unit 10 to perform computational processing on this two-dimensional filtering data to calculate one assessment value (unevenness amount), and here, an overall RMS value (effective value) is calculated by the following equation, and this result is used as an iteration score (step 418: iteration score calculating step).

$$\text{Assessment value (unevenness amount)} = \sqrt{\frac{1}{M}\sum_{i=1}^{M}(x_i)^2} \qquad \text{Equation 1}$$

$x_i$: value of each item of data $M$: total number of data values

Next, the control unit 9 compares the iteration score calculated in step 418 with the target unevenness rank that was set by the target unevenness rank setting means 22, and judges whether the iteration score of the captured image is compatible with the target unevenness rank (step 419: judging step). For example, in a case where "B Rank" is set as the target unevenness rank in step 402, if the iteration score is 5 or less in the table shown in FIG. 11, this score is compatible with the target unevenness rank, even if the iteration score corresponds to "golden rank" or "A Rank". If the iteration score is not compatible with the target unevenness rank, the control unit 9 repeats the processing from step 411 onward, and if the iteration score is compatible with the target unevenness rank, the control unit 9 generates unevenness correction data based on the iteration data stored in the storage means 14 at that point (step 420), and uses the unevenness correction data storage means 6 to store this generated unevenness correction data in the mounted memory (step 421).

Figure 17A:
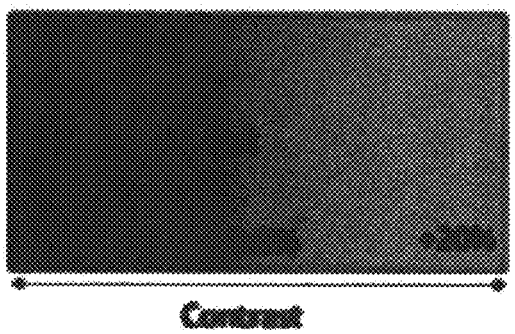
FIGS. 17A to 17C are explanatory diagrams showing (a) gradation unevenness, (b) spot unevenness, and (c) stripe unevenness, as examples of unevenness that occurs in a display panel.
Figure 17B:
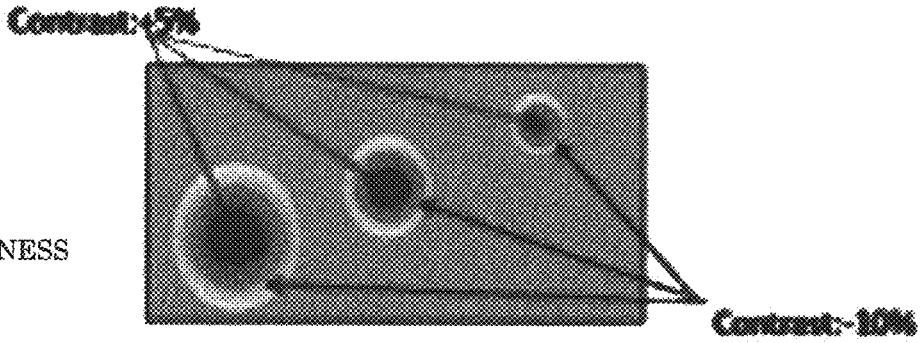
Figure 17C:
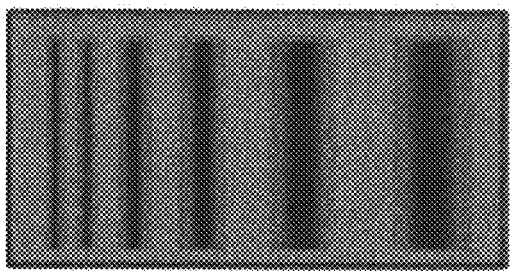
Figure 18:
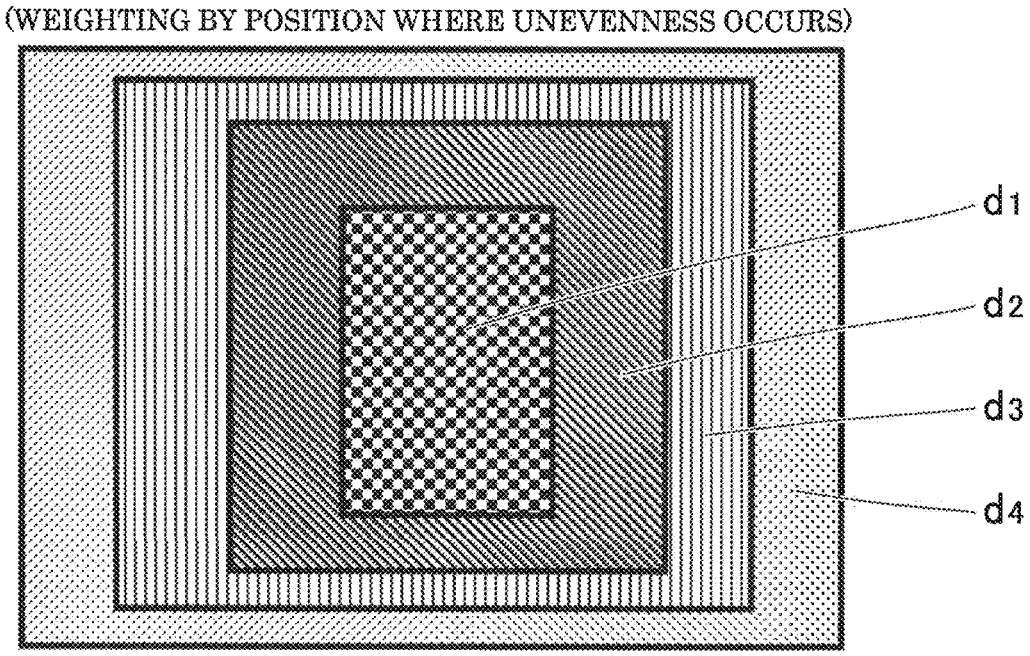
FIG. 18 is an explanatory diagram showing an example of weighting in the unevenness correction data generation system of FIG. 9.

Incidentally, the unevenness that occurs in the display panel 2 is actually various and complicated, but when the unevenness is classified, as shown in FIGS. 17A to 17C, for example, there is gradation unevenness that gradually decreases from one end side to the other end side of the screen (FIG. 17A), there is spot-like spot unevenness (FIG. 17B), and there is vertical stripe-like stripe unevenness (FIG. 17C). When such unevenness is quantitatively assessed using an iteration score in consideration of human visual characteristics, it is appropriate to weight the unevenness according to the position where the unevenness occurs. Humans with left and right eyes positioned horizontally are more sensitive to unevenness on the left and right than unevenness on the top and bottom of a screen. Therefore, it is desirable to calculate the iteration score with more emphasis on weighting in the horizontal direction, and less weighting in the vertical direction. Furthermore, because human eyes are more sensitive to unevenness in the center than unevenness at the peripheral portion of a screen, and unevenness near the center of the screen is unacceptable, for example, as shown in FIG. 18, it is conceivable to assign the heaviest weighting to an area $d_1$ in the centermost portion of the screen and exaggerate the assessment of that area, and give successively less weight to an area $d_2$, an area $d_3$, and an area $d_4$ at the periphery of the center area $d_1$.

Figure 19:
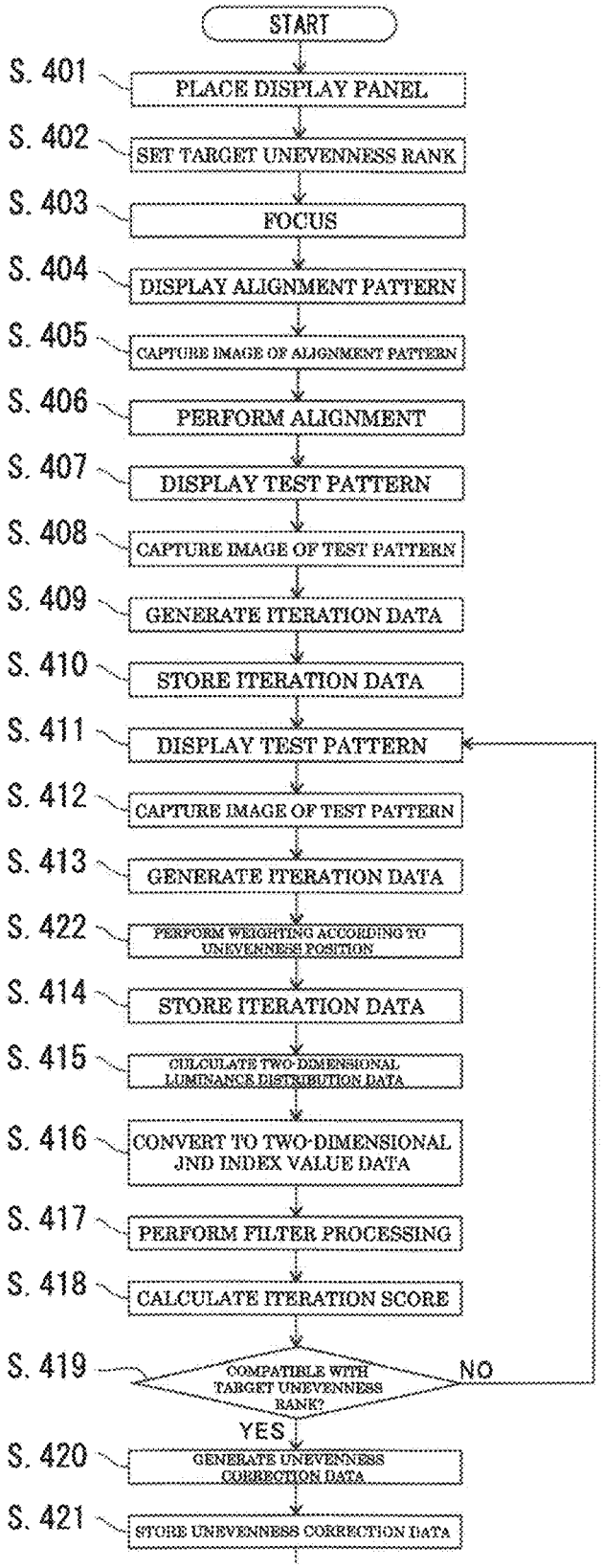
FIG. 19 is a flowchart showing another example of an unevenness correction data generation method according to the unevenness correction data generation system of FIG. 9.

As shown in FIG. 19, in order to perform this sort of weighting processing, after iteration data has been generated in step 413 with the unevenness correction data generation method shown in FIG. 10, weighting processing may be performed on this iteration data (step 422: weighting step). The numbers assigned to the contour line pattern in FIG. 16 indicate the result of weighting by a filter or the like. In this contour line pattern, high luminance portions near the center of the screen have high scores of 6 to 8 (assessment values when the degree of unevenness is bad), and low luminance portions existing at the periphery of the screen have low scores of about 0 to 2 (assessment values when the degree of unevenness is comparatively good). In a case where the target unevenness rank that was set in step 402 is the "A Rank" in the table shown in FIG. 11, in order to be compatible with that rank, the processing from step 411 onward needs to be repeated at least until the high score portions have a score of 3 or less.

The unevenness correction data generation method according to the present embodiment includes: a first image capturing step of capturing an image of the display panel 2 in a state where a predetermined pattern is displayed; a first iteration data generating step of generating iteration data for correcting unevenness of the image captured in the first image capturing step; a first storing step of storing the iteration data generated in the first iteration data generating step in the storage means 14; a second image capturing step of capturing an image of the display panel 2 in a state where a pattern corrected by the iteration data stored in the storage means 14 is displayed; a second iteration data generating step of generating iteration data for correcting unevenness of the image captured in the second image capturing step; a second storing step of storing, in the storage means 14, new iteration data obtained by adding the iteration data generated in the second iteration data generating step to the iteration data stored in the storage means 14; a repeating step of repeating the second image capturing step, the second iteration data generating step, and the second storing step (the number of repetitions may also be one repetition); a judging step of judging whether or not an ending condition for ending the repeating step is satisfied; and an unevenness correction data generating step of generating unevenness correction data for correcting unevenness of the display panel 2 based on the iteration data stored in the storage means 14 when judged in the judging step that the ending condition is satisfied. Therefore, even in a case where, for example as in Patent Document 1, correction is performed after generating correction data only once and so only about 80% of unevenness is corrected, in the method according to the present embodiment, generation of iteration data (the second iteration data generating step) is repeated, and image capturing of a corrected pattern (the second image capturing step) is performed a plurality of times. Therefore, it is possible to generate unevenness correction data for correcting 90% or more, or alternatively, nearly 100% of unevenness.

Accordingly, display panel yield can be effectively improved, and it becomes possible to reuse many display panels that conventionally were defective products and could not be used, so the amount of defective products that occur can be greatly reduced.

Also, by using the fact that the number of instances of image capturing has reached a predetermined number of instances as the ending condition, indefinite repetition of image capturing is prevented, and by using the fact that white noise was detected as the ending condition, or alternatively, by using the fact that a bright line or a bright spot was detected as the ending condition, repetition of useless image capturing is prevented, and therefore it is possible to shorten the takt time.

Furthermore, as shown in FIGS. 10 and 19, the method according to the present embodiment also includes an iteration score generating step of generating an iteration score that quantifies unevenness of the image captured in the second image capturing step, and by using the fact that the iteration score is compatible with a preset target as the ending condition, it becomes possible for a display panel manufacturer or a user to obtain a display panel that is compatible with a desired unevenness standard, and therefore the display panel yield can be markedly improved.

Example embodiments of the present invention are disclosed above, but embodiments of the present invention are not limited to those described above, and such embodiments may be appropriately modified or the like within a range that does not depart from the gist of the present invention.

For example, the display panel is not limited to being an organic EL panel, and may be a liquid crystal panel or a plasma display (PDP), or alternatively, may be a projection-type projector or the like.

Also, rather than generating unevenness correction data with respect to a white (gray) raster pattern in which all RGB colors are lit, a configuration may be adopted in which unevenness correction data is generated with respect to a red raster pattern in which only red (R) is lit, a green raster pattern in which only green (G) is lit, or a blue pattern in which only blue (B) is lit, or unevenness correction data may be generated with respect to a display image other than a raster pattern.

Furthermore, although each of the methods shown in FIGS. 6 to 8, 10 and 19 are embodiments of the method shown in FIG. 2, each of the methods shown in FIGS. 6 to 8, 10 and 19 may be embodiments of the method shown in FIG. 5, or may be embodiments of another method. Also, arbitrary modes can be adopted for the configuration of the unevenness correction apparatus, the iteration score generation method, and the weighting method.

DESCRIPTION OF REFERENCE SIGNS

1: unevenness correction data generation system
2: display panel
3: unevenness correction apparatus
5: image capturing means
8: ending condition setting means
9: control unit (unevenness correction data generation means)
11: judging means
12: control means
13: iteration data generation means
14: storage means

What is claimed is:

1. An unevenness correction data generation method for generating unevenness correction data for correcting unevenness of a display panel, the method comprising:

a first image capturing step of capturing an image of a display panel in a state where a predetermined pattern is displayed;

a first iteration data generating step of generating iteration data for correcting unevenness of the image captured in the first image capturing step;

a first storing step of storing the iteration data generated in the first iteration data generating step in a storage means;

a second image capturing step of capturing an image of the display panel in a state where a pattern corrected by the iteration data stored in the storage means is displayed;

a second iteration data generating step of generating iteration data for correcting unevenness of the image captured in the second image capturing step;

a second storing step of storing, in the storage means, new iteration data obtained by adding the iteration data generated in the second iteration data generating step to the iteration data stored in the storage means;

a repeating step of repeating the second image capturing step, the second iteration data generating step, and the second storing step;

a judging step of judging whether or not an ending condition for ending the repeating step is satisfied; and an unevenness correction data generating step of generating the unevenness correction data based on the iteration data stored in the storage means when judged in the judging step that the ending condition is satisfied.

2. The unevenness correction data generation method according to claim 1, wherein the ending condition is that a number of instances of image capturing in the second image capturing step has reached a predetermined number of instances.

3. The unevenness correction data generation method according to claim 1, further comprising:

a white noise detecting step of detecting white noise in the image captured in the second image capturing step, wherein the ending condition is that the white noise was detected.

4. The unevenness correction data generation method according to claim 1, further comprising:

a white noise detecting step of detecting white noise in the image captured in the second image capturing step, wherein the ending condition is that a number of instances of image capturing in the second image capturing step has reached a predetermined number of instances, or that the white noise was detected before the number of instances of image capturing in the second image capturing step reached the predetermined number of instances.

5. The unevenness correction data generation method according to claim 1, further comprising:

a bright line/bright spot detecting step of detecting a bright line or a bright spot in the image captured in the second image capturing step, wherein the ending condition is that the bright line or the bright spot was detected.

6. The unevenness correction data generation method according to claim 1, further comprising:

a bright line/bright spot detecting step of detecting a bright line or a bright spot in the image captured in the second image capturing step, wherein the ending condition is that a number of instances of image capturing in the second image capturing step has reached a predetermined number of instances, or that the bright line or the bright spot was detected before the number of instances of image capturing in the second image capturing step reached the predetermined number of instances.

7. The unevenness correction data generation method according to claim 1, further comprising:

an iteration score generating step of generating an iteration score that quantifies unevenness of the image captured in the second image capturing step, wherein the ending condition is that the iteration score is compatible with a preset target.

8. The unevenness correction data generation method according to claim 7, wherein the iteration score generating step includes:

a luminance distribution data calculating step of calculating two-dimensional luminance distribution data of the display panel based on the image captured in the second image capturing step;

a filter processing step of performing filter processing on the two-dimensional luminance distribution data, using a filter that is a visual transfer function curve for the display panel such that as spatial frequency increases, recognition sensitivity increases, then reaches a peak and decreases, and in a case where a plurality of such visual transfer function curves are assumed at different distances from the display panel, a visual transfer function curve having visual frequency characteristics approximately passing through a portion where the recognition sensitivity increases as the spatial frequency increases in a short-distance function curve having a short distance from the display panel among the plurality of visual transfer function curves, a peak portion in the short-distance function curve, a peak portion in a far-distance function curve having a far distance from the display panel among the plurality of visual transfer function curves, and a portion where the recognition sensitivity decreases as the spatial frequency increases in the far-distance function curve; and an iteration score calculating step of calculating the iteration score based on two-dimensional filtering data obtained by performing the filter processing using the filter.

9. The unevenness correction data generation method according to claim 7, wherein the iteration score generating step includes a weighting step of performing weighting by assessing that unevenness that occurs in a central portion of the image captured in the second image capturing step is more significant than unevenness that occurs in a peripheral portion.

10. The unevenness correction data generation method according to claim 8, wherein the iteration score generating step includes a weighting step of performing weighting by assessing that unevenness that occurs in a central portion of the image captured in the second image capturing step is more significant than unevenness that occurs in a peripheral portion.

11. An unevenness correction data generation system that generates unevenness correction data for correcting unevenness of a display panel, the system comprising:

an image capturing means for capturing an image of a pattern displayed on the display panel;

an iteration data generation means for generating iteration data for correcting unevenness of the image captured with the image capturing means;

a storage means for storing the iteration data generated with the iteration data generation means;

an unevenness correction data generation means for generating the unevenness correction data; and a control means for controlling the image capturing means, the iteration data generation means, and the unevenness correction data generation means;

wherein the control means uses the image capturing means to capture an image of a display panel in a state where a predetermined pattern is displayed, uses the iteration data generation means to generate iteration data for correcting unevenness of the captured image, and stores the generated iteration data in the storage means, and afterward, the control means repeats a sequence of using the image capturing means to capture an image of the display panel in a state where a pattern corrected by the iteration data stored in the storage means is displayed, using the iteration data generation means to generate iteration data for correcting unevenness of the captured image, and storing, in the storage means, new iteration data obtained by adding the generated iteration data to the iteration data stored in the storage means, and also judges whether or not an ending condition for ending this repetition is satisfied, and when judged that the ending condition is satisfied, the control means uses the unevenness correction data generation means to generate the unevenness correction data based on the iteration data stored in the storage means.

* * * * *